United States Patent [19]

Cortelyou, Jr.

[11] Patent Number: 4,709,478

[45] Date of Patent: Dec. 1, 1987

[54] WINDOW PAINT SCRAPER

[76] Inventor: David H. Cortelyou, Jr., 95 Franklin Ave., Staten Island, N.Y. 10301

[21] Appl. No.: 914,670

[22] Filed: Oct. 2, 1986

[51] Int. Cl.[4] ..... B26B 3/00

[52] U.S. Cl. ..... 30/169; 15/236 R

[58] Field of Search ..... 30/169–172, 30/136; 15/236 R, 93 R

[56] References Cited

U.S. PATENT DOCUMENTS

| | | | |
|---|---|---|---|
| 1,327,153 | 1/1920 | Gottschalk | 30/171 |
| 2,636,529 | 4/1953 | Miltenburg | 30/169 X |
| 2,737,717 | 3/1956 | Johnson | 30/171 UX |
| 2,787,056 | 4/1957 | Dobratz | 30/170 |
| 2,818,642 | 1/1958 | Judd | 30/169 |

FOREIGN PATENT DOCUMENTS 2117303 10/1983 United Kingdom .

*Primary Examiner*—Douglas D. Watts

*Attorney, Agent, or Firm*—Erza Sutton

[57] ABSTRACT

A window paint scraper comprising a scraper body having a handle portion and a lower surface adapted to slide along a windowpane from which excess paint is to be removed. The scraper body includes left and right side walls one of which is used as a guide as the scraping operation is performed and the body also includes a sloping front surface to which a razor blade is secured lying at the proper angle to perform an optimum scraping operation. The blade is narrower than the front surface and it lies slightly below the scraper body. In operation of the scraper, one of the side walls is aligned with the putty on the windowpane or the sash and as it is moved along the windowpane, over the excess paint thereon, the razor blade removes excess paint and leaves an esthetically smooth and straight line of paint on the windowpane. With its two wall guides, the scraper can be operated in any direction on a window.

7 Claims, 4 Drawing Figures

FIG. 1
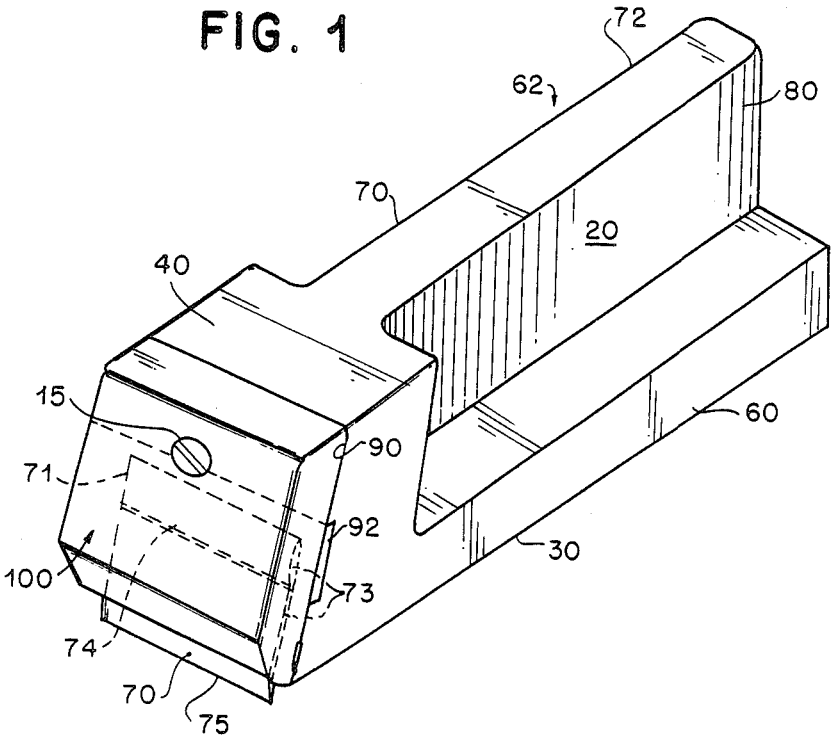
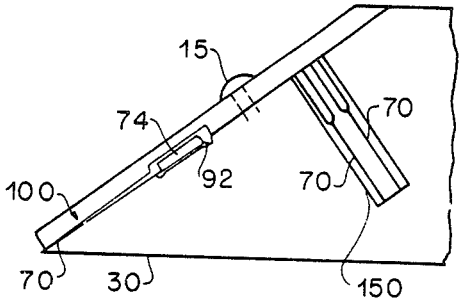
FIG. 2

FIG. 3
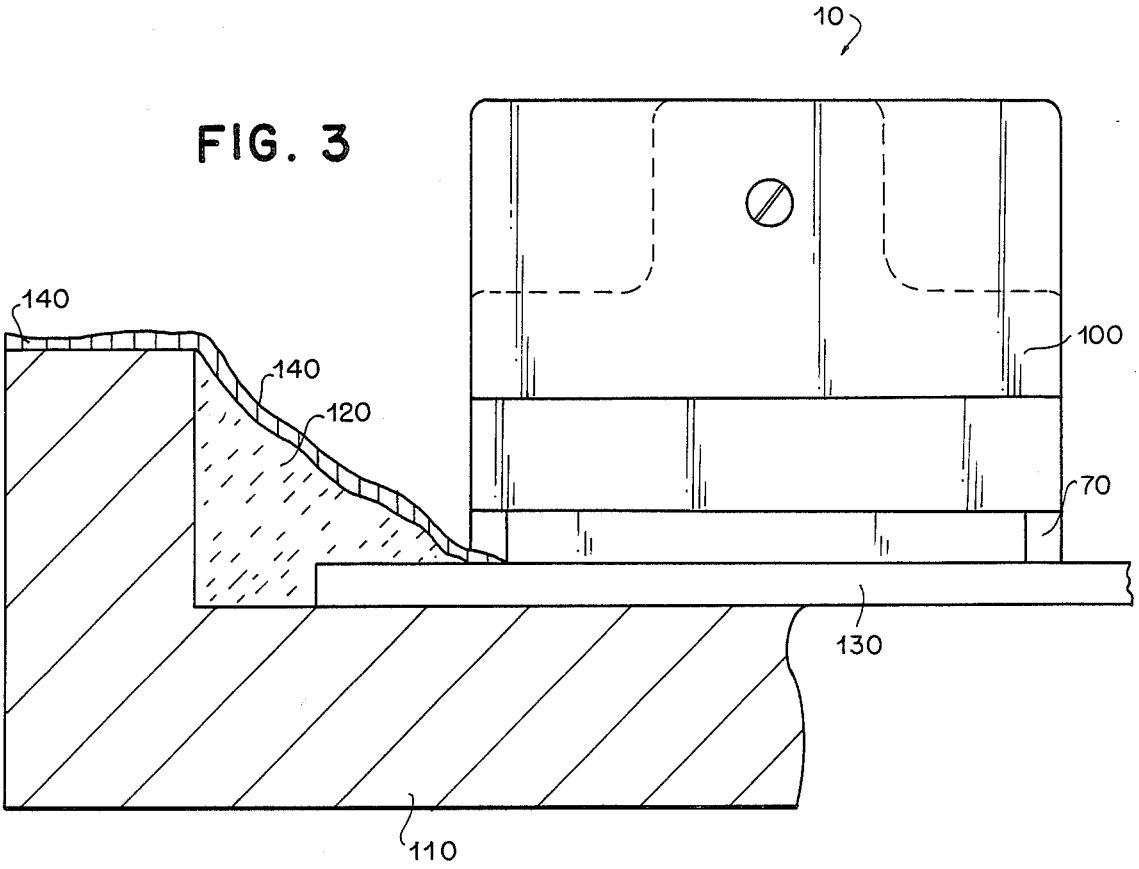
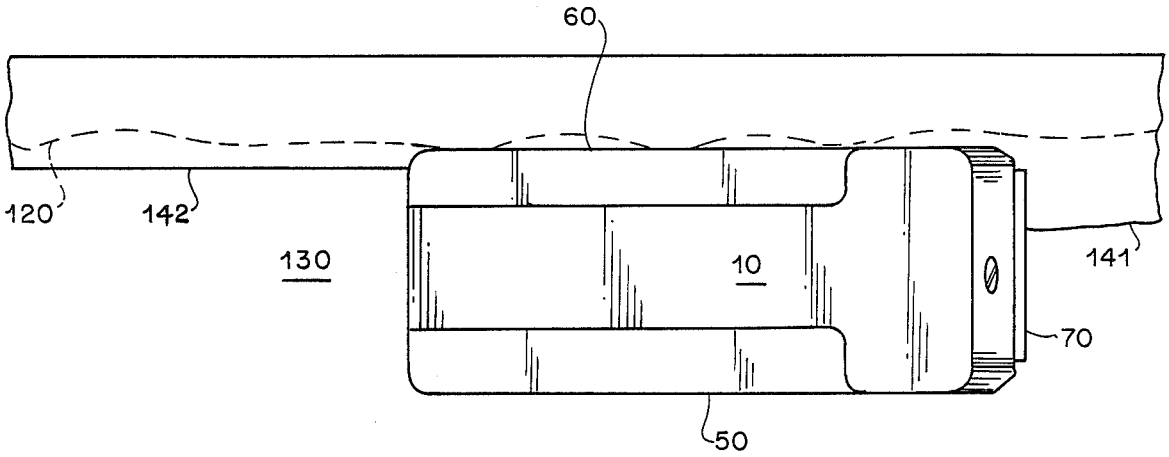
FIG. 4

WINDOW PAINT SCRAPER

BACKGROUND OF THE INVENTION

At the current state of the art, it is almost impossible to paint a window frame without getting paint on the window pane itself. It is possible to mask the frame or putty using masking tape; however, this is time consuming and wasteful of tape. Present practice is to attempt to scrape paint off the window pane after the paint has dried using a paint scraper consisting of a razor blade mounted in a holder which is held at some variable angle to the window pane. Many window panes are held in place using a putty which retains some resiliency even after it has dried. In the attempt to scrape excess paint off the window, the putty presents two problems. First, its presence makes it difficult for the user of a scraper to follow the contour of the putty closely, thereby producing a non-uniform paint line. In addition, there is the problem of maintaining a constant angle of blade with respect to the window pane to prevent breakage or deterioration of blades after little use. Also, the putty itself, which is necessary for a water-tight seal, is often removed or deformed whereby the seal is damaged.

SUMMARY OF THE INVENTION

An object of the invention is to provide a paint scraper for windows which allows the removal of dried excess paint without damaging the putty seal.

Another object of the invention is to provide a window paint scraper which leaves an aesthetically pleasing border of paint on a window glass.

Briefly, the scraper of the invention includes a body having guide walls for guiding the scraping process, the body having a wall for supporting a scraper blade of narrower width than the body. The guide walls permit the scraper to be positioned and operated to easily remove excess paint and provide an effective and aesthetically pleasing result.

DESCRIPTION OF THE DRAWINGS

In the drawings:

FIG. 1 is a perspective view of the scraper of the invention;

FIG. 2 is a side elevational view of a portion of the apparatus shown in FIG. 1;

FIG. 3 is a front, elevational view, partly in section of a portion of a window pane at the putty seal and a scraper embodying the invention in operative relation therewith; and FIG. 4 is a plan view of a portion of a window pane at the putty seal and a scraper embodying the invention and illustrating the operation of the invention in performing a scraping operation.

DESCRIPTION OF THE INVENTION

A paint scraper 10 embodying the invention comprises a scraper body 20 of any suitable material having a flat, smooth horizontal bottom surface 30 and a flat horizontal top surface 40. Left and right side walls 50 and 60, respectively, which are vertical and parallel to each other, rise upwardly from the bottom surface 30. A portion of the body is shaped to provide a handle 62 for the user and, essentially, the handle is formed by having a portion of the scraper body cut out from the top surface 40 downwardly a short distance. The handle thus includes a portion of the top surface and left and right side walls 70 and 80 which are positioned closer together than the side walls 50 and 60. The body of the scraper includes a front wall 90 which slopes downwardly and forwardly so that the front surface has a positive slope as seen in FIG. 1. The surface 90 preferably forms a 45 degree angle with the vertical.

The front surface 90 is provided with a transverse depression 92 in which the thicker, finger-gripping portion 74 of a single-edge blade 70 is seated and secured when the cover plate 100 is in place.

A razor blade 70 or other scraping member is seated on the sloping front surface 90 of the body 20 and is secured by a cover plate 100 which is adapted to be seated on the blade and held in place by a screw 15 or the like which penetrates the front sloping surface. It is noted that the razor blade 70 is narrower than the front surface and has left and right vertical edges 71 and 73, respectively, which do not reach to the side walls 50 and 60 but terminate perhaps one-eighth inch away from these side walls. In addition, the blade 70 is positioned so that its cutting or scraping edge 75 projects beneath the lower surface of the cover which is generally coplanar with the lower surface of the scraper body itself. The blade preferably projects about one-eighth inch below the cover and scraper body and its scraping edge 75 projects forwardly at least as far as the lower edge of the cover as seen in FIG. 2. It is noted that the blade 70 is oriented at the optimum angle for performing a scraping operation due to the slope of the surface or wall 90.

In one embodiment of the invention a slot 150 is provided in the body of the scraper formed in the front surface and extending downwardly into the body of the scraper from the front surface at about a 45 degree angle. This slot serves as a storage chamber for extra razor blades, preferably at least two.

The operation of the scraper of the invention is described with respect to FIGS. 3, and 4 in which are seen a portion of a window frame 110 , putty seal 120, window pane 130 and a layer of paint 140 on the window frame and on the putty and extending slightly onto the window glass adjacent to the putty. It can be seen that the paint has a non-uniform ragged edge 141 (FIG. 4). The scraper 10 is positioned with its bottom surface 30 flat on the window pane over the excess paint on the window and it is aligned with the edge of the putty by using the appropriate side wall 50 or 60 as a guide. With the blade positioned at the desired angle and with its side wall positioned about $\frac{1}{8}$ inch from the edge of the putty, the scraper is moved along the window and the desired paint is removed and the desired straight paint line as seen at 142 in FIG. 4 remains behind the scraper as the scraper moves along the window. With the blade positioned as described, and with the scraper positioned, for example at the lower horizontal portion of the window frame, the scraper can be moved right up to the paint edge along the left vertical portion of the window frame at the end of the path of scraping. Next, the scraper can be moved along the left vertical portion of the window frame to remove excess paint and in this way and it can be moved along all sides of the window or sash.

What is claimed is:

1. A window paint scraper for removing paint from a windowpane comprising:

an elongated one-piece scraper body having a flat bottom surface and left and right parallel, vertical sidewalls, each of which comprises a guide wall for a user in operation of the scraper, said left and right guide walls extending continuously from front to rear of the scraper body for permitting one of said guide walls to engage and rest on a windowpane in alignment with and alongside the edge of a putty line which extends along the windowpane and is coated with paint which extends beyond the putty line and over the windowpane;

said scraper body having a handle which is integral with said one-piece body;

said scraper body having a flat bottom surface which, due to the use of said guide wall, is adapted to glide over said windowpane and over excess paint thereon immediately adjacent said putty line or sash;

said scraper body having a front surface disposed at an angle relative to said bottom surface;

a razor blade mounted on said front surface of said scraper body at said angle; the two side edges of said blade being spaced inwardly from said respective left and right guide walls, the cutting edge of said blade extending slightly below said bottom surface of said scraper body at the forward edge thereof so that said cutting edge of said blade removes excess paint from beyond said putty line from said windowpane as it is moved along the windowpane and so that the edges of said guide walls are raised above the surface of said windowpane so that the bottom surfaces of said left and right guide walls are raised slightly above the surface of the windowpane and can glide over the excess paint adjacent to the putty on said windowpane;

a blade-retaining cover for said razor blade on the front surface of said scraper body and removably secured thereto, whereby a razor blade can be seated on or removed from said front surface; and means for removably attaching said razor blade and cover to said front surface of said scraper body;

and including a compartment extending from said front surface into said body at about a 45 degree angle and operable as a storage chamber for receiving extra razor blades, said chamber being covered by said cover when said cover is in place in said front surface.

2. A window paint scraper in accordance with claim 1 wherein the blade on said front surface is disposed at an angle of about 45 degrees to said bottom surface of said body.

3. A window paint scraper in accordance with claim 1 wherein said side edges of said blade are spaced inwardly from said side walls a distance of about one-eighth of an inch.

4. A window paint scraper in accordance with claim 1 wherein said cutting edge of said blade extends below the forward edge of said bottom surface of said body a distance of about one-eighth of an inch.

5. A window paint scraper as defined in claim 1 and including a transverse slot in said front surface for receiving the finger-gripping portion of a single edge razor blade.

6. The scraper defined in claim 1 wherein the side edges of said razor blade are spaced inwardly about $\frac{1}{8}$ inch from said guide walls so that when said scraper is operated, it leaves approximately $\frac{1}{8}$ inch of paint extending adjacent to the putty on the windowpane.

7. The scraper defined in claim 1 wherein the cutting edge of said blade extends about $\frac{1}{8}$ inch below said bottom surface.

* * * * *